United States Patent [19]

Lionetto et al.

[11] Patent Number: 4,929,188

[45] Date of Patent: May 29, 1990

[54] COAXIAL CONNECTOR ASSEMBLY

[75] Inventors: Gene Lionetto, Milford; Stephen Brown, Derry, both of N.H.

[73] Assignee: M/A-Com Omni Spectra, Inc., Merrimack, N.H.

[21] Appl. No.: 337,363

[22] Filed: Apr. 13, 1989

[51] Int. Cl.[5] ..... H01R 13/627

[52] U.S. Cl. ..... 439/349; 439/578; 439/607; 439/827

[58] Field of Search ..... 439/345, 349, 351, 352, 439/355, 370, 578–585, 675, 851–858, 607, 827

[56] References Cited

U.S. PATENT DOCUMENTS

| | | | |
|---|---|---|---|
| 3,793,610 | 2/1974 | Brishka | 439/349 |
| 4,050,149 | 9/1977 | Storck et al. | 439/852 |
| 4,326,769 | 4/1982 | Dorsey et al. | 439/578 |
| 4,426,127 | 1/1984 | Kubota | 439/578 |
| 4,786,262 | 11/1988 | Molitor et al. | 439/852 |

FOREIGN PATENT DOCUMENTS

| | | | |
|---|---|---|---|
| 1411067 | 10/1975 | United Kingdom | 439/585 |

*Primary Examiner*—David Pirlot

*Attorney, Agent, or Firm*—Hayes, Soloway, Hennessey & Hage

[57] ABSTRACT

A microminiature coaxial connector is described. The connector comprises a male half and a female half and an annular electrical spring contact member which functions to provide continuous annular outer conductor electrical contact and RFI suppression. The annular spring member provides continuous annular outer conductor contact between facing surfaces at said male and female surfaces even during slight conductor misalignment. The spring is retained on said female member by a groove adjacent the outer end thereof, the outer end thereof is tapered away from a collar defining the outer end of the groove towards its axis, and the male member is at least 5% larger in diameter than the diameter of said female member adjacent the collar and said spring member extends at least 5% beyond the diameter of said collar.

7 Claims, 2 Drawing Sheets

COAXIAL CONNECTOR ASSEMBLY

The present invention is directed to a coaxial connector assembly, particularly the microminiature type wherein the total assembly is less than ¼ inch in diameter. The present invention is an improvement over the coaxial connector described in U.S. Pat. No. 4,426,127 owned by the Assignee of the present invention.

BACKGROUND OF THE INVENTION

In microminiature coaxial connectors there is normally an outer shield comprising a male half and a female half and an annular electrical spring contact is often provided for furnishing continuous annual outer electrical contact between the two members so as to assure shielding of the inner coaxial conductor from radio frequency interference and other electrical phenomena which can adversely affect the quality of the signal being carried by the inner coaxial conductor.

BRIEF DESCRIPTION OF THE INVENTION

In the present invention the spring member is carried by the female portion of the outer pair of shielding conductors and is held in a groove which extends from near the outer end of the female conductor. This outer end is preferably tapered towards the axis of the conductor, the outer end providing a collar which defines one end of the groove for retaining the spring. The spring extends outwardly from the female member by at least 5% of the diameter of the female member and the female member is preferably at least 5% smaller in diameter than is the male member. Thus, when the male member and the female member are in engagement and coaxially aligned, the electrical contact between the two is primarily through the spring contact. This arrangement also permits easy engagement and disengagement of the two mating members and permits a reasonable amount of misalignment between the axes of the two members. The electrical contact will still be continuous and shielding will not be disturbed even though the two elements are not coaxially aligned but one is displaced from the axis by a substantial distance from the other because of manufacturing tolerances or other problems.

In a preferred form of the invention, a snap ring of larger outer diameter than the interior surface of the male connector and a smaller inner diameter than the collar on the female connector is carried in a groove in the male surface. When the female member is inserted, the taper end enters the snap ring and expands it over the collar. Then, as the collar is fully seated, the snap ring passes into the spring retaining groove behind the collar and contracts into this groove thus holding the female member against dislodgement.

DETAILED DESCRIPTION OF THE INVENTION

Figure 1:
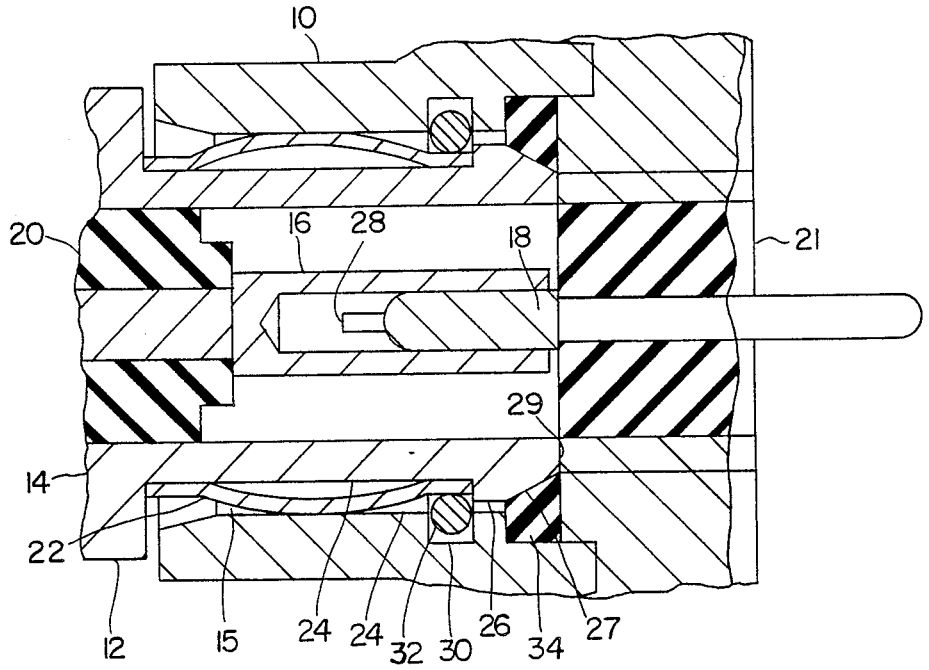
Figure 2:
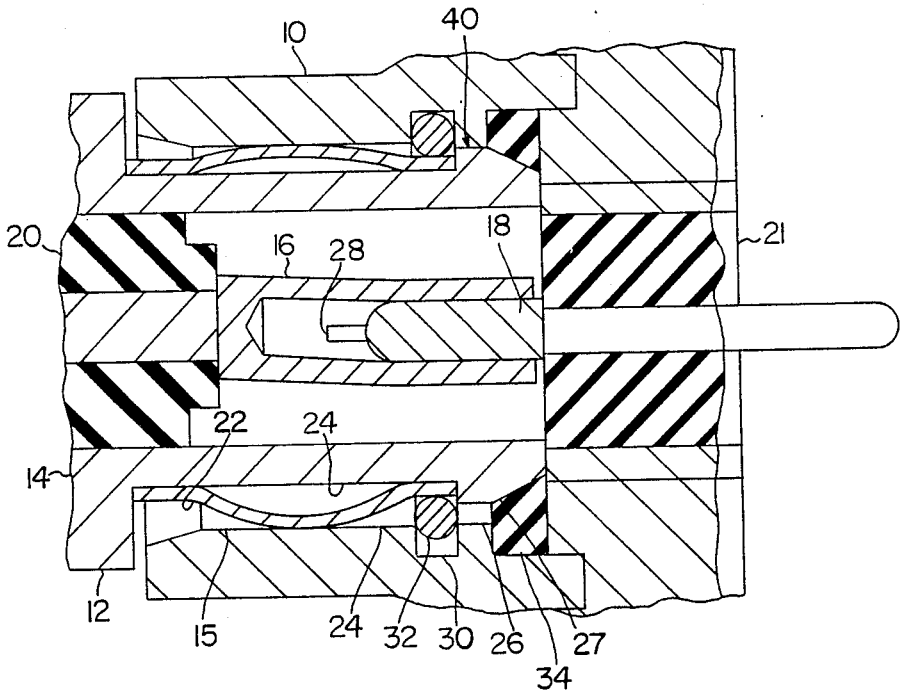

For a fuller understanding of the invention reference should be had to the following detailed description taken in connection with the following drawings wherein:

FIG. 1 is a schematic diagrammatic partially section view of one preferred form of the invention; and FIG. 2 is another view of FIG. 1 with one of the axes of the mating conductor slightly displaced from the other.

Referring now to FIG. 1 the outer male shield conductor is shown generally at 10 and the female outer conductor is shown generally at 12 having an internal sleeve 14 which fits within the inner surface 15 of sleeve 10. An inner coaxial conductor 16 is arranged to be engaged by a corresponding internal coaxial conductor 18 carried in association with the member 12. Insulators 20 and 21 space the internal coaxial conductors 16, 18 from the outer shield members. An annular leaf spring 22 is carried in a groove 24 in the outer surface of the female contact member 14 associated with an outer shield. The collar 26 adjacent the outer end of the groove serves to hold the spring in the groove. This collar is at least 5% smaller in diameter than the diameter of the surface 15 of the male member 10 and the collar 26 is tapered 27 at its outer end 29 by approximately 15°. The inner conductor 16 preferably has a number of longitudinal slots 28 which permit axial misalignment between the inner coaxial members 16 and 18. There is also provided on the interior surface of the male member 10 a groove 30 which receives a snap ring 32. In its normal condition the snap ring 32 has an external diameter larger than the diameter of the surface 15 so that it is held in the groove 30 in its normal position. The inner diameter of snap ring 32 is less than the outer diameter of the collar 26. Thus, after the collar passes through the snap ring in the process of engagement, the snap ring closes down into the groove 24 and engages the back corner of the collar 26 holding it against removal.

As can be seen in FIG. 1, where the two members are in complete axial alignment, the inner female member 14 is uniformally spaced from the interior surface 15 of the outer male member 10 and the electrical contact is essentially through the leaf spring 22 and a conductive elastomer 34 against which the tapered surface 27 abuts.

In FIG. 2 the inner and outer members are not axially aligned but the inner member has been displaced upwardly so that the upper surface of the inner member adjacent the collar abuts the inner surface 15 at the top of the drawing, i.e. at 40, and at the bottom of the drawing the spacing between the collar and the surface is twice the normal spacing. In both cases the spring 22 engages the inner surface 15 of the outer member 10. As can be seen in FIG. 2 the slots 28 on the inner female coaxial contact 16 permit bending of this female contact to accommodate misalignment with the male inner coaxial contact 18.

We claim:

1. A micro-miniature coaxial connector comprising, in combination, a male half and a female half having facing surfaces, and an annular electrical spring contact member which functions to provide continuous annular outer conductor electrical contact and RFI suppression, wherein the annular spring member provides continuous annular outer conductor contact between facing surfaces at said male and female surfaces even during slight conductor misalignment, said spring being retained on said female member by a groove adjacent the outer end thereof, said outer end being tapered away from a collar defining the outer end of the groove towards its axis, an engaging diameter of outer end of said male connector half having a tapered surface adjacent to said tapered end of said female connector half to aid in aligning said halves when mating, said male member being at least 5% larger in diameter than the diameter of said female member adjacent the collar and said spring member extending at least 5% beyond the diameter of said collar; and a snap ring of larger outer diameter than said male surface and of smaller inner diameter than said collar carried in a groove in said male surface into which the snap ring can expand when the female member is inserted into engagement with the male surface, said lock ring contrating into said groove behind the collar when said surfaces are in full engagement to lock said surfaces against axial movement.

2. A connector of claim 1, wherein said collar is at least 5% smaller in diameter than the interior diameter of said male member, so that when said male half and female half are axially aligned electrical contact is primarily through said spring element.

3. A connector of claim 1, and further comprising an electrically conductive elastomer gasket ring, carried on said male member against which said outer end taper of said female member may engage and compensates for misalignment of said male and female connector halves when fully engaged, providing continuous circumferential electrical contact and RFI suppression.

4. A micro-miniature coaxial connector comprising in combination an outer half and an inner half having facing surfaces, an annular electrical spring contact member which functions to provide continuous annual outer conductor electrical contact and RFI suppression, wherein the annular spring member provides continuous annular outer conductor contact between facing surfaces of said outer and inner halves even during slight conductor misalignment, said spring contact member being retained on one of said halves by a groove adjacent the outer end thereof, said outer end being tapered away from a collar defining the outer end of the groove, the inner surface of the outer half being at least five percent larger in diameter that the outer surface of the inner half, said measurements being adjacent the spring retaining collar, said spring member in its uncompressed state spanning a distance greater than the spacing between said inner and outer halves and being compressible to span the smaller spacing formed when said two inner and outer halves are assembled, and a snap ring carried by that one of the members which does not carry the spring member, the snap ring having an inner diameter greater than the collar diameter and an outer diameter greater than the collar diameter whereby when it passes over the collar it is retained by the collar against axial movement.

5. A micro-miniature coaxial connector comprising in combination an outer half and an inner half, an annular electrical spring contact member located in a groove adjacent an outer end thereof, said spring member in its uncompressed state spanning a distance greater than the spacing between said inner and outer halves and being compressible to span the smaller spacing formed when said two inner and outer halves are assembled, a conductive elastomer tapered ring contacted by a tapered end of said inner half and an inner diameter land in said outer half, and a snap ring to retain an assembled connector's said outer half and inner half against axial movement.

6. A micro-miniature coaxial connector of claim 5, wherein said inner coaxial conductor can be fitted with said internal coaxial conductor pin, and said outer shield conductor fitted with said inner coaxial conductor socket, and reversibly with said inner conductor fitted with said conductor socket and said outer shield conductor fitted with said conductor pin.

7. A micro-miniature coaxial connector comprising in combination an outer half and an inner half, an annular electrical spring contact member located in a groove adjacent in outer end thereof, said spring member in its uncompressed state spanning a distance greater than the spacing between said inner and outer halves and being compressible to span the smaller spacing formed when said two inner and outer halves are assembled, a conductive elastomer tapered ring contacted by a tapered end of said inner half and an inner diameter land in said outer half, and a snap ring being engaged by a collar and a groove when said connector halves are joined.

* * * * *

UNITED STATES PATENT AND TRADEMARK OFFICE

CERTIFICATE OF CORRECTION

PATENT NO. : 4,929,188

DATED : May 29, 1990

INVENTOR(S) : Gene LIONETTO and Stephen BROWN

It is certified that error appears in the above-identified patent and that said Letters Patent is hereby corrected as shown below:

In claim 7, line 31, change "in" to --an--. (1st occurr.)

Signed and Sealed this

Eleventh Day of June, 1991

*Attest:*

*Attesting Officer*

HARRY F. MANBECK, JR.

*Commissioner of Patents and Trademarks*